US007768343B1

(12) United States Patent
Sinitsky

(10) Patent No.: US 7,768,343 B1
(45) Date of Patent: Aug. 3, 2010

(54) START-UP CIRCUIT FOR BANDGAP REFERENCE

(75) Inventor: Dennis Sinitsky, Los Gatos, CA (US)

(73) Assignee: Marvell International Ltd., Hamilton (BM)

( * ) Notice: Subject to any disclaimer, the term of this patent is extended or adjusted under 35 U.S.C. 154(b) by 224 days.

(21) Appl. No.: 11/820,181

(22) Filed: Jun. 18, 2007

(51) Int. Cl.
*G05F 1/10* (2006.01)
*G05F 3/02* (2006.01)

(52) U.S. Cl. ..... 327/539

(58) Field of Classification Search ..... 327/539, 327/512, 513; 323/313, 316, 315, 901
See application file for complete search history.

(56) References Cited

U.S. PATENT DOCUMENTS

| | | | | |
|---|---|---|---|---|
| 6,060,918 | A * | 5/2000 | Tsuchida et al. | 327/143 |
| 6,201,435 | B1 * | 3/2001 | Chou | 327/543 |
| 6,784,652 | B1 * | 8/2004 | Aude | 323/316 |
| 6,906,581 | B2 | 6/2005 | Kang et al. | 327/539 |
| 7,071,767 | B2 | 7/2006 | Ou-yang et al. | 327/539 |
| 7,224,209 | B2 * | 5/2007 | Hsu | 327/538 |
| 7,253,598 | B1 * | 8/2007 | Doyle et al. | 323/316 |
| 2003/0080806 | A1 | 5/2003 | Sugimura | 327/539 |
| 2008/0150594 | A1 * | 6/2008 | Taylor et al. | 327/143 |

OTHER PUBLICATIONS

H. Banba, et al., "A CMOS Bandgap Reference Circuit with Sub-1-V Operation", IEEE Journal of Solid-State Circuits, vol. 34, No. 5, May 1999, pp. 670-674.

A. Boni, "Op-Amps and Startup Circuits for CMOS Bandgap References With Near 1-V Supply", IEEE Journal of Solid-State Circuits, vol. 37, No. 10, Oct. 2002, pp. 1339-1343.

T. Li, et al., "A Low Voltage Bandgap Reference Circuit with Current Feedback", EECS 413 Project.

A. Pierazzi, et al., "Band-Gap References for near 1-V operation in standard CMOS technology", IEEE 2001 Custom Integrated Circuits Conference, pp. 463-466.

* cited by examiner

*Primary Examiner*—Quan Tra

(57) ABSTRACT

A start-up circuit for a bandgap reference circuit includes a sampling circuit for sampling current through a diode in one of first and second diode/resistor networks that respectively provide complementary PTAT and CTAT characteristics in the bandgap reference, and a current injection circuit to inject current to a PMOS bus of the bandgap reference if the sampled current is not higher than a pre-designated low value. By virtue of this operation, since current through the diode itself is sampled, the start-up circuit ensures that current through the sampled diode is higher than the pre-designated low value, thereby leading to rapid start-up of the bandgap reference to a stable operating point.

36 Claims, 9 Drawing Sheets

START-UP CIRCUIT FOR BANDGAP REFERENCE

FIELD OF THE INVENTION

The present invention relates to a start-up circuit for a bandgap reference voltage circuit, such as a bandgap reference circuit that produces a voltage and/or a current reference, and particularly a bandgap reference circuit that provides a low-level voltage and/or current as its output.

BACKGROUND OF THE INVENTION

One important part of many analog and digital devices is a generator for a voltage reference or a current reference which exhibits good characteristics. Here, "good characteristics" means that the generator for the reference generates a voltage or a current that is stable or changes only nominally over a wide range of supply voltages (which typify battery-powered devices) and over a wide range of temperature variations, and which can also be implemented with existing fabrication processes, preferably as part of other circuitry for the device.

The bandgap reference is a popular reference generator that successfully satisfies these requirements. Its principal of operation is widely understood: essentially, the bandgap reference uses cancellation from components that exhibit proportional-to-absolute-temperature (PTAT) characteristics and components that exhibit complementary-to-absolute-temperature (CTAT) characteristics, so as to generate a voltage that is relatively independent of temperature and supply voltage.

One drawback of conventional bandgap reference circuitry is that, when supplying a reference voltage, the lowest possible reference voltage is limited to a low value of approximately 1.27v. With increasing emphasis on reductions in power, so as to extend battery life, reduce power consumption, and reduce heat generation, the industry has worked to develop a bandgap reference circuit that provides a voltage reference whose low-level voltage is less than 1.27v.

For example, Banba, et al. introduced a bandgap reference circuit with sub-1v operational output. See Banba, et al., "A CMOS Bandgap Reference Circuit With Sub-1-v Operation", IEEE Journal of Solid-State Circuits, Vol. 34, No. 5, p. 670-674 (May, 1999). The principle of operation for such a bandgap reference circuit will be explained with respect to FIG. 1.

FIG. 1 shows a bandgap reference circuit 10 according to the proposal of Banba, et al. The bandgap reference circuit 10 includes a bandgap core 11 and an output circuit 12 for outputting a reference voltage Vout. Bandgap core 11 includes a pair of complementary first and second diode/resistor networks that exhibit PTAT and CTAT characteristics, respectively. The PTAT diode/resistor network comprises resistor R2A connected in parallel to series-connected resistor R1 and N diodes D1. The CTAT diode/resistor network comprises resistor R2B connected in parallel to a single diode D2. Typically, resistors R2A and R2B have the same value, i.e., R2A=R2B. First and second current mirrors comprising transistors MPA and MPB are driven from a common PMOS bus 14, and feed current to the first and second diode/resistor networks. Because the currents are mirrored, current iA through MPA is equal to current iB through MPB. A differential amplifier OP1 has its differential inputs driven by voltage VA from the PTAT diode/resistor networks, and by voltage VB from the CTAT diode/resistor network. The output of OP1 drives the common PMOS bus.

Output circuit 12 outputs the voltage reference Vout, and comprises a third current mirror which includes transistor MP3 driven from the common PMOS bus together with a series-connected resistor R3. Since transistor MP3 is driven from the same PMOS bus 14, current i3 through transistor MP3 is the same as currents iA and iB. The output circuit acts to combine (such as through addition and multiplication) voltages produced by the PTAT and CTAT diode/resistor networks, thereby producing a reference voltage Vout that is stable over a wide range of temperatures and supply voltages VDD. In addition, the generated reference voltage is lowered relative to pre-1999 bandgap references by the ratio of resistor R3 to resistor R2A, thereby achieving sub-1v operation. Furthermore, because of its implementation using CMOS components, fabrication of the FIG. 1 bandgap reference circuit can be achieved on a shared basis of other components of analog and digital devices.

FIG. 1 shows that the output of a bandgap reference is not necessarily limited to the output of a reference voltage. A reference current can also (or alternatively) be provided. As shown in FIG. 1, transistor MP3' is driven from PMOS bus 14, and outputs a current reference iout. In the case that transistor MP3' is identical to transistor MP3, the value of iout is iout=Vout/R3.

One problem with the FIG. 1 is evident: its start-up characteristics are unpredictable and can be unstable. The Banba, et al. authors pointed out that a stable, but unusable, state of the circuit can be obtained where VA=VB=0. To avoid this undesirable state, Banba, et al. proposed a current injection device indicated generally at 15 directly onto PMOS bus 14, in the form of a power-on reset (POR). Such an approach has its own difficulties. In 2002, a researcher named Andrea Boni explained that current for the POR injection might or might not be stable or even available, since the device was itself in the process of power on. See Boni, "Op-Amps and Start-up Circuits for CMOS Bandgap References with Near 1-V Supply", IEEE Journal of Solid State Circuits, Vol. 37, No. 10, p. 1339-1343 (October, 2002). Boni proposed direct injection of currents at 16, in the form of current IX and IY, so as to perturb the diode/resistor networks and force the diodes into a current-conducting state.

The inventor herein has observed that even with the aforementioned provisions for start-up, there are still situations where the bandgap circuit of FIG. 1 can fail to start or can start to an unreliable and unstable operational state. Consider, for example, a situation where VA=VB=0.6 volts (approximately), which is substantially smaller than the forward bias diode voltage of 0.7 volts. In this situation, there is zero current flowing through the diodes D1 and D2 of the diode/resistor networks, which signifies a failed start-up of the bandgap reference. However, because current can flow through resistors R2A and R2B, the bandgap circuit can still achieve stable operation that is quite close to a true bandgap solution (i.e., within around 80%), thereby making it impossible to detect such undesirable operational points simply by sampling VA or VB. This undesirable operating point is different from that noted by Banba, et al., which occurs at VA=VB=0. As a consequence, the system is weakly unstable, and might oscillate for a long period of time before reaching a desired operational point at which there is current flow through diodes D1 and D2.

SUMMARY OF THE INVENTION

The present invention addresses start-up difficulties in bandgap circuitry that provides a voltage and/or current reference. Although usable in any bandgap circuit, the invention finds particular utility in bandgap circuitry that provides a voltage reference of low levels at or below 1 volt.

In keeping with the invention, current through diodes D1 and/or D2 is sampled so as to ensure that current through the diode itself is higher than a pre-designated low value. If the sampling indicates that current through the diode is lower than the pre-designated low value, then current is injected to the PTAT and CTAT networks of the bandgap reference, until such time as sampling indicates that current through the diode is higher than the pre-designated low value.

By virtue of this operation, since current is sampled through the diode itself, a stable start-up condition is ensured since current injection will continue until current through the diode is higher than the pre-designated low value. The bandgap reference consequently achieves a stable operating state since the circuit is correctly driven until the diodes achieve the conduction that is needed to achieve PTAT and CTAT operation of the diode/resistor networks.

In one aspect, start-up circuitry for a bandgap reference circuit includes a sampling circuit to sample current in a diode of one of first and second diode/resistor networks in the bandgap reference, and a current injection reference circuit to inject current to the PMOS bus thereof if the current sampled by the sampling circuit is not higher than a pre-designated low value. This forces current into the CTAT and PTAT networks.

The sampling circuit may comprise a differential amplifier and an emulation diode structured in equivalence to that of the sampled diode, wherein one differential input of the differential amplifier is connected so as to sample voltage at the sampled diode and the other input thereof is connected to the emulation diode in a negative feedback relationship with the output of the differential amplifier, such that current through the emulation diode is substantially the same as that through the sampled diode.

Likewise, in preferred aspects, the current injection circuit may comprise a current mirror driven by the output of the differential amplifier and providing a current to a resistor network selected in correspondence with the pre-designated low value, wherein a voltage across the resistor network triggers current injection to the PMOS bus when current through the emulation diode falls below the pre-designated low value. Current injection may be triggered via a Schmidt trigger or other circuitry that continues to supply current injection to the PMOS bus until the current is greater than the pre-designated low value.

The sampling circuit can sample current through the diode of either the first or the second diode/resistor circuit of the bandgap reference, or it can be arranged to sample current through both of them.

This brief summary has been provided so that the nature of the invention may be understood quickly. A more complete understanding of the invention can be obtained by reference to the following detailed description of the preferred embodiment thereof in connection with the attached drawings.

DETAILED DESCRIPTION OF THE PREFERRED EMBODIMENT

Figure 1:
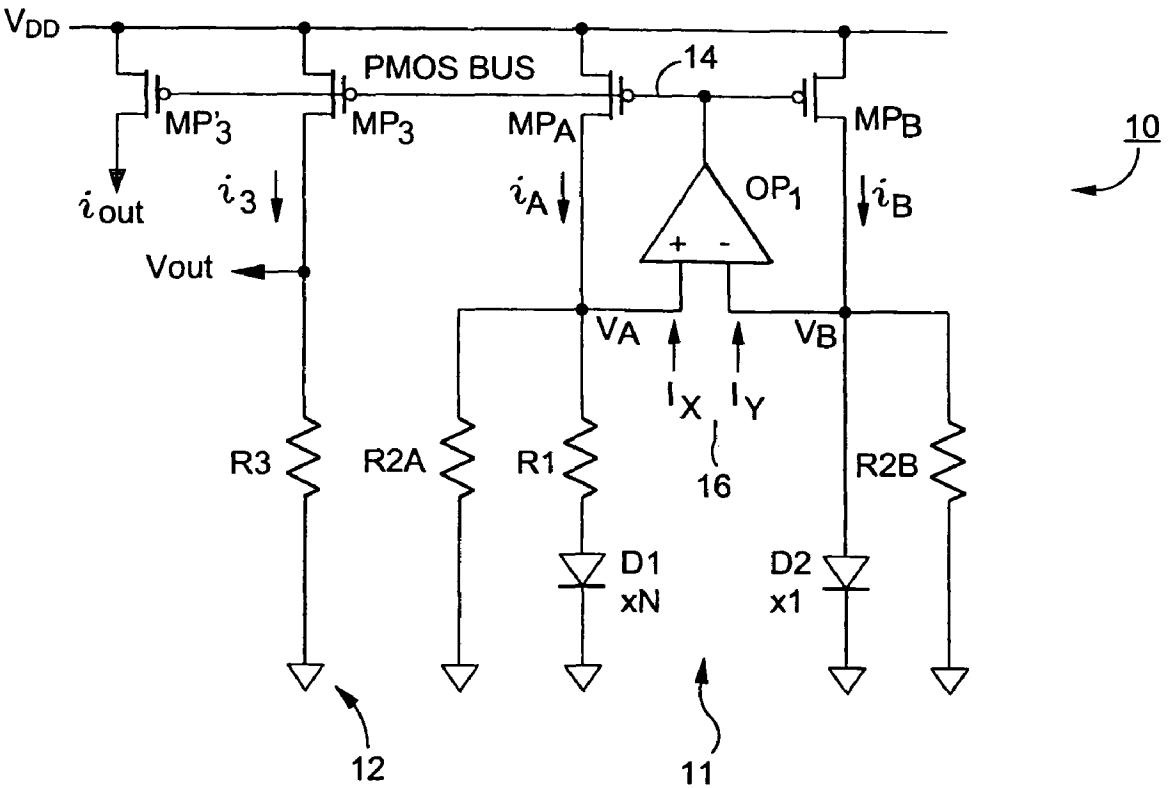
FIG. 1 (PRIOR ART)
FIG. 1 is a schematic diagram of a bandgap reference circuit according to the prior art.
Figure 2:
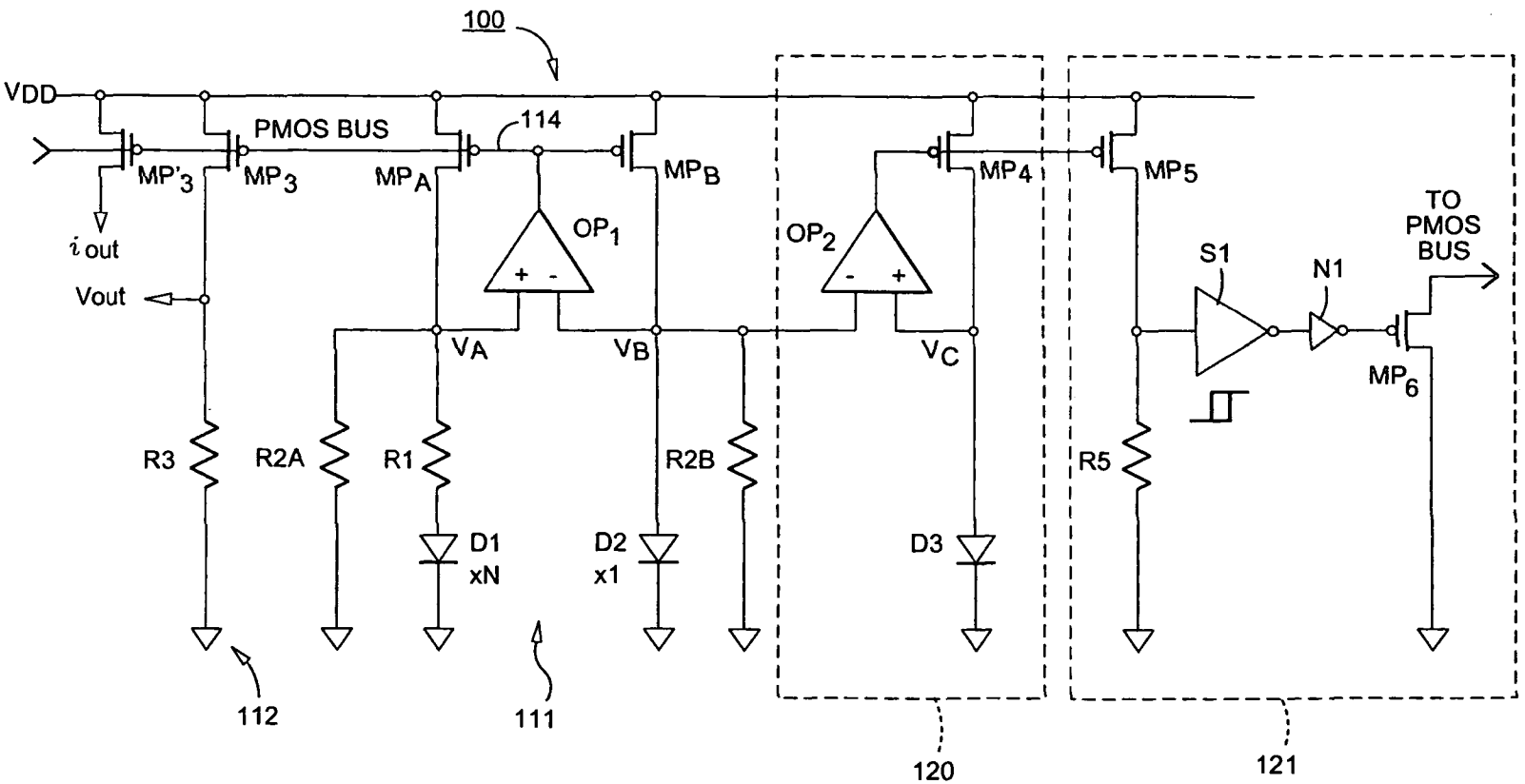
FIGS. 2 through 5 are schematic drawings of bandgap reference circuits, with start-up circuitry, according to the first through fourth embodiments of the invention.

FIG. 2 is a detailed schematic according to a first embodiment of the invention. FIG. 2 shows bandgap reference circuit 100 which includes a bandgap core 111 and an output circuit 112. Bandgap core 111 and output circuit 112 are generally similar to corresponding elements shown in FIG. 1 herein, and descriptions thereof will therefore be omitted in the interest of brevity.

FIG. 2 also shows start-up circuitry which includes a sampling circuit 120 and a current injection circuit 121. The sampling circuit 120 operates to sample current in diode D2, and to mirror that current through emulation diode D3. Emulation diode D3 is identical to the sampled diode, here, diode D2. Sampling circuit 120 includes op-amp OP2 whose negative differential input is connected to diode D2 thereby sampling voltage VB. The positive input to op-amp OP2 is connected to emulation diode D3 which is series-connected to transistor MP4. Transistor MP4 forms a current source for current flowing through emulation diode D3. In addition, transistor MP4 is connected to the output of op-amp OP2, thereby forming a negative feedback circuit such that current through emulation diode D3 is substantially the same as that through the sampled diode, which in this embodiment is diode D2.

The current through emulation diode D3 is the same as the current through the sampled diode because of the negative feedback loop formed by the interconnection of op-amp OP2 and transistor MP4. This negative feedback loop forces voltage VC to be equal to voltage VB. Since VC=VB, the voltage drops across sampled diode D2 and emulation diode D3 are the same. As a consequence, and since emulation diode D3 is identical to sampled diode D2, the currents through diodes D2 and D3 are also the same.

Current injection circuit 121 is formed from transistor MP5 in series with resistor R5, which together form a current mirror for current through transistor MP4. The current mirror is driven by output from op-amp OP2. The value of resistor R5 is chosen in correspondence to the pre-designated low value of current that is targeted for flow through diode D2 so as to ensure stable start-up of the bandgap core 111. As a consequence, when the voltage across resistor R5 falls to a small value, signifying that there is insufficient current flowing through the sampled diode, then Schmidt trigger 51 is triggered to an ON state. Conversely, when voltage across resistor R5 is sufficiently high, then Schmidt trigger S1 is triggered to an OFF state.

The output of Schmidt trigger S1 is coupled to NAND gate N1 which inverts its output, and the inverted output is provided to transistor MP6 which drives PMOS bus 114 low so as to inject current into the bus, under the conditions described above. This, in turn, forces transistors MPA and MPB to inject more current into the PTAT and CTAT networks of bandgap core 111.

Use of a Schmidt trigger like Schmidt trigger S1 is desirable, because of the hystersis prevention inherent therein, which reduces the possibility of rapid on and off cycles of current injection to PMOS bus 114. However, in other embodiments, use of inverter N1 alone would suffice.

It should be noted that in the FIG. 2 embodiment, sampling circuit 120 is arranged to sample current through diode D2. It will be evident to those of ordinary skill, however, that sampling circuit 120 can also be arranged so as to sample the current through diodes D1, so as to achieve the same effect as that shown in FIG. 2, by connecting the negative input of op-amp OP2 to point VA instead of VB.

It should further be appreciated that sampling circuitry other than the precise circuitry shown at 120 can also be used, so long as the sampling circuitry provides a sample of current flowing through the sampled diode.

Figure 3:
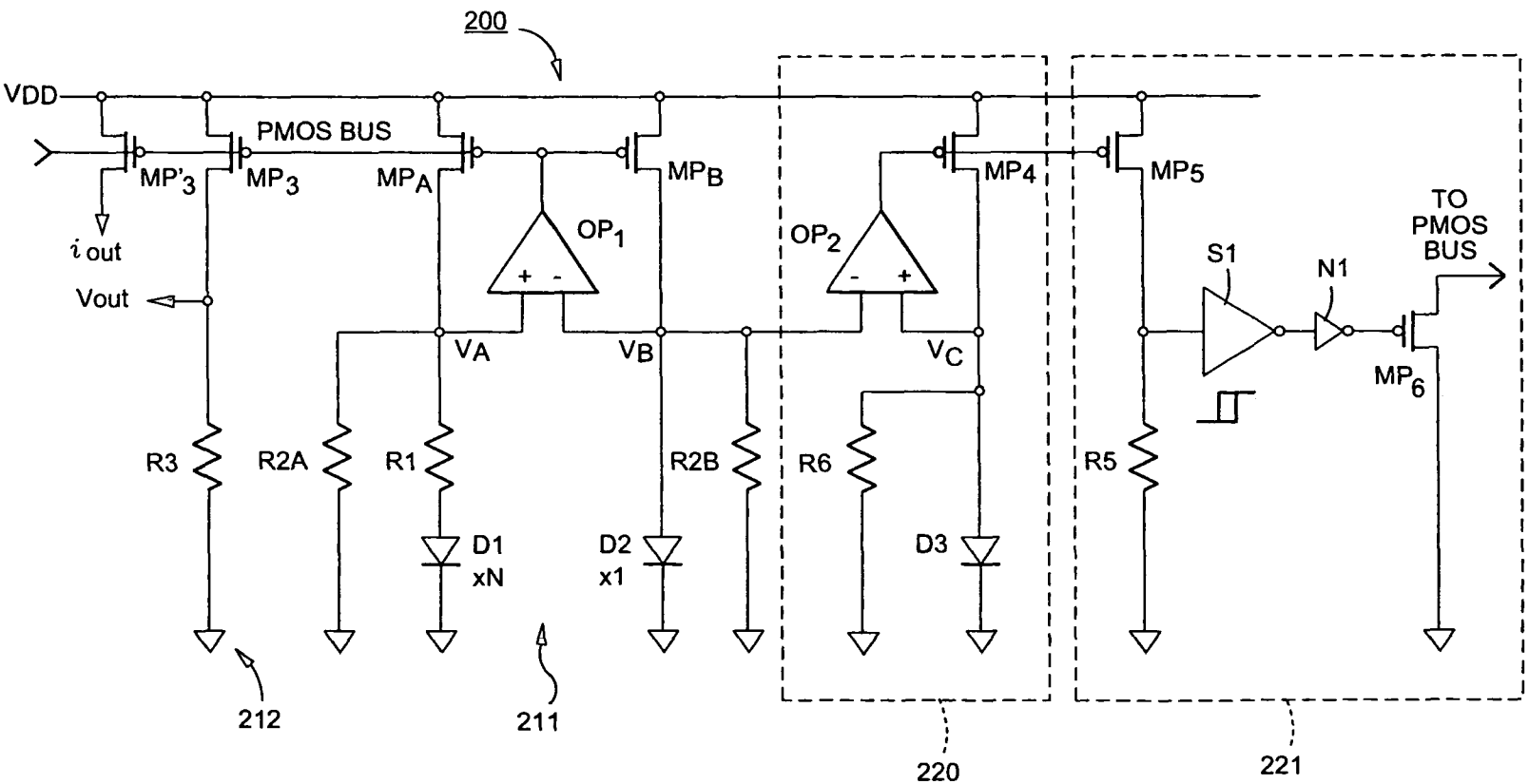

FIG. 3 shows another embodiment of the invention. Like-numbered reference numerals have been used, and a description of these elements is omitted in the interest of brevity.

One way that the embodiment of FIG. 3 differs from that of FIG. 2 is the provision of resistor R6 in parallel across emulation diode D3. The presence of resistor R6 helps to ensure that even if emulation diode D3 is off, i.e., there is no current flow through emulation diode D3, current still flows through transistor MP4, thus ensuring proper operation of the negative feedback provided by the presence of transistor MP4. Resistor R6 thus performs the function of providing a bleeder current. Generally speaking, the value of resistor R6 should be chosen to a number far greater than the corresponding resistor R2B. For example, the value of resistor R6 can be chosen so that it is ten times greater than that of resistor R2B.

Figure 4:
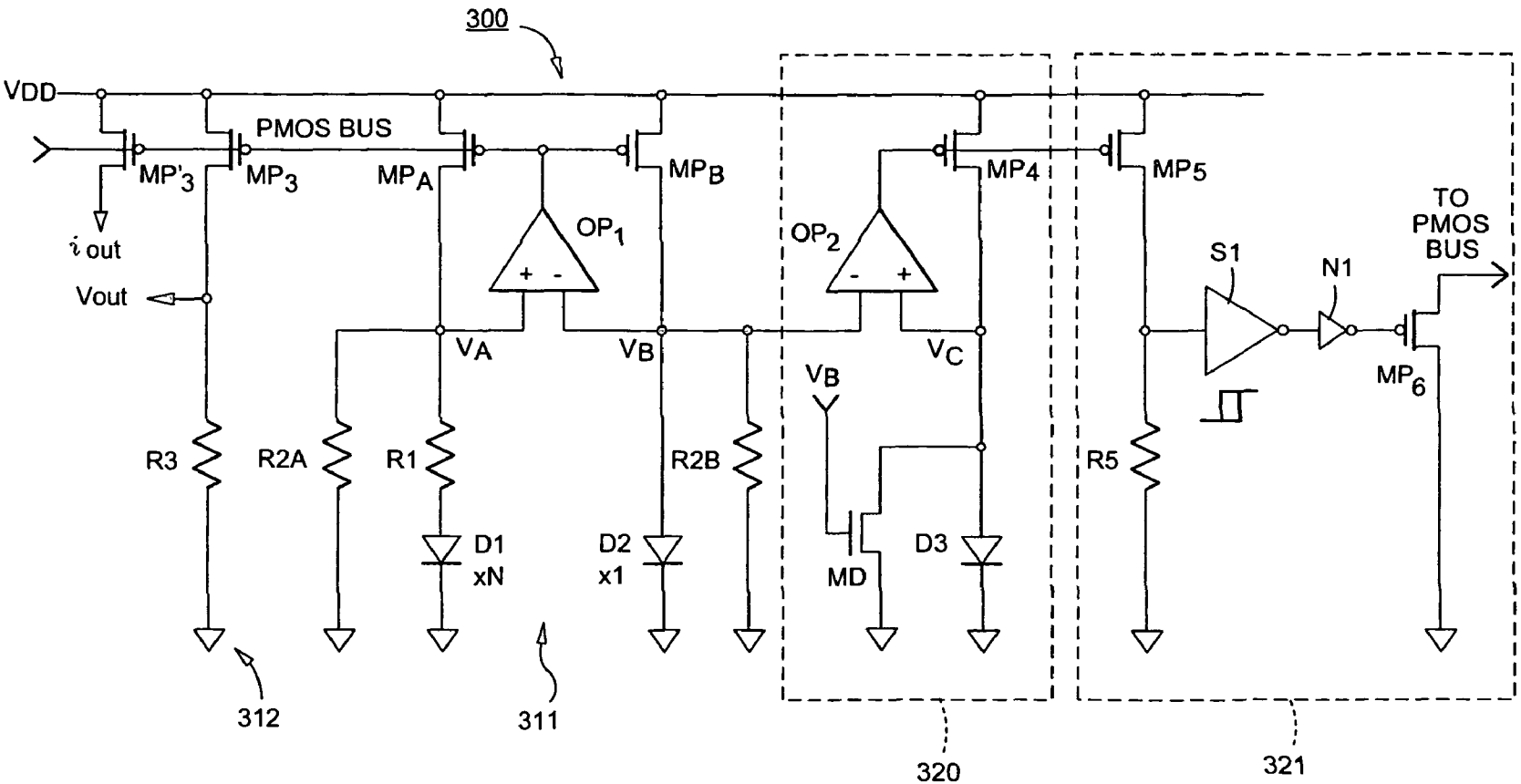

FIG. 4 shows another embodiment of the invention. Like-numbered reference numerals have been used, and a description of these elements is omitted in the interest of brevity.

One way that the embodiment of FIG. 4 differs from that of FIG. 3 is in the replacement of resistor R6 with a transistor, here, transistor MD, which performs the bleeder current function. This embodiment of FIG. 4 is preferable in situations where chip-area of resistor R6 is too large, and unduly interferes with fabrication and layout geometry and efficiency of the chip. In this case, the transistor can be used instead, with its gate voltage tied to voltage VB, thereby ensuring that the on-resistance of the transistor is much larger than resistor R2B.

Figure 5:
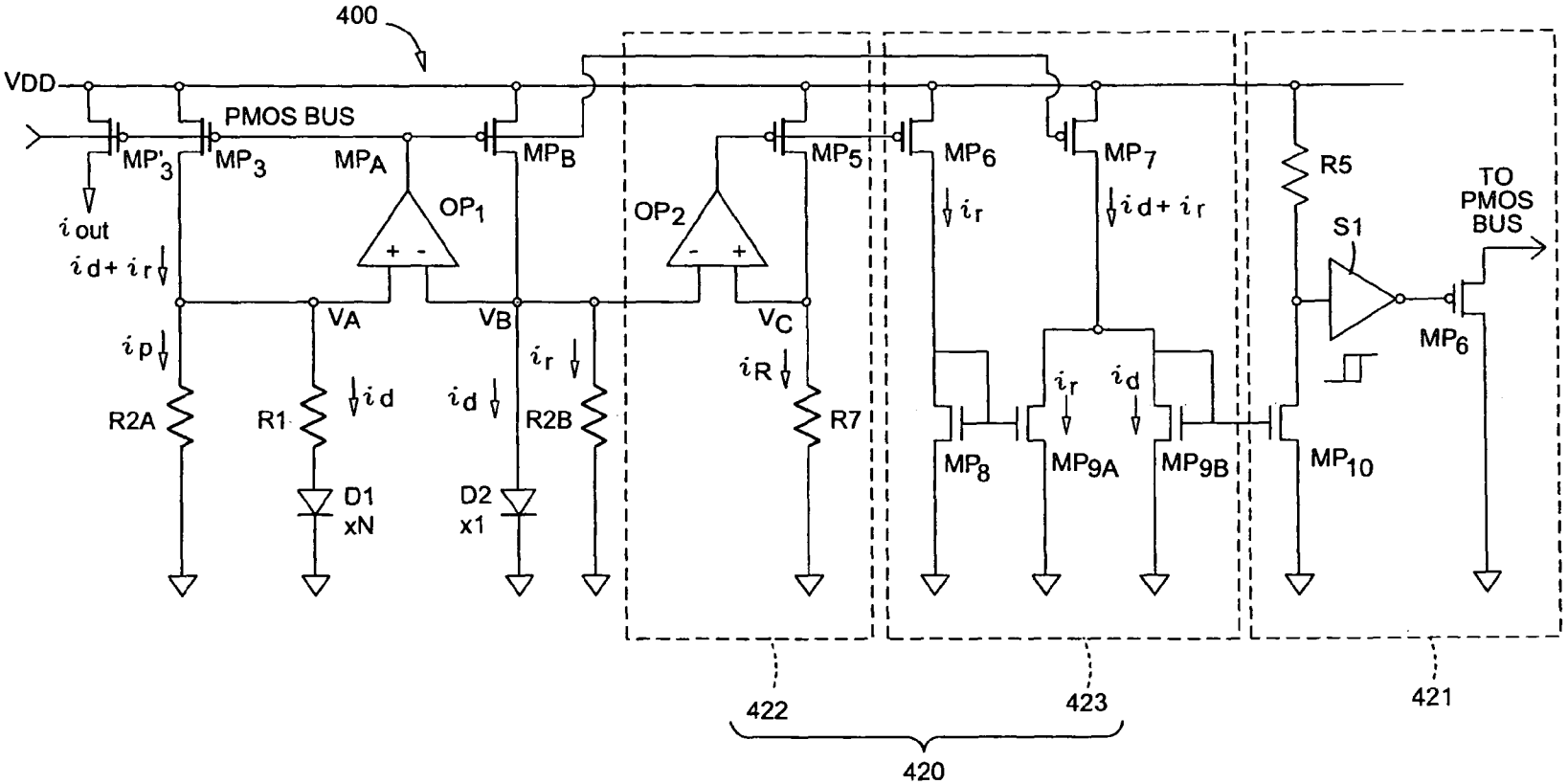

FIG. 5 shows another embodiment of the invention. Like-numbered reference numerals have been used, and a description of these elements is omitted in the interest of brevity.

One way that the embodiment of FIG. 5 differs from that of FIGS. 2 through 4 is that sampling circuit 420 is comprised of a sensing circuit 422 and a current subtraction circuit 423. More particularly, as in other embodiments, sampling circuit 420 is responsible for sampling current id flowing through the sampled diode, which in this case is diode D2. In the embodiment of FIG. 5, sampling circuit is comprised of a sensing circuit 422 which senses the current ir flowing through resistor R2B. Sensing circuit 422 is followed by subtraction circuit 423, which subtracts the current ir sampled by sensing circuit 422 from a sample of the current flowing through transistor MPB. Since the current flowing through transistor MPB is equal to the sum of the current id flowing through diode D2 and the current ir flowing through resistor R2B, the output of subtraction circuit 423 is a sample of the current id flowing through diode D2, as intended.

A detailed description of sensing circuit 422 and subtraction circuit 423 follows. Sensing circuit 422 includes op-amp OP2 connected in a negative feedback loop through transistor MP5. The negative input to op-amp OP2 samples voltage VB, and the positive input to op-amp OP2 is connected to resistor R7 such that the voltage VC is equal to VB. Resistor R7 is identical to resistor R2B. Consequently, since VC=VB, and the value of R7=R2B, the current ir flowing through R7 is the same as the current ir flowing through resistor R2B.

Subtraction circuit 423 includes transistor MP6 arranged as a current mirror for current flowing through transistor MP5, such that, the current flowing through transistor MP6 is equal to ir. Likewise, transistor MP7 is arranged as a current mirror for current flowing through transistor MPB, such that current flowing through transistor MP7 is equal to id+ir. NMOS transistors MPB, MP9A and MP9B are arranged in a subtraction arrangement, so as to subtract the current ir flowing through transistor MP6 from the current id+ir flowing through transistor MP7. The output at transistor MP9B is therefore id, which is a sample of the current flowing through the sampled diode D2.

Current injection circuit 421 is somewhat different than like circuits of other embodiments. Here, current injection circuit 421 includes resistor R5 arranged on top of NMOS transistor MP10. Schmidt trigger S1 feeds PMOS transistor MP6, whose output injects current to PMOS bus 114. Since resistor R5 is arranged on top of transistor MP10, there is ordinarily no need for an inverter such as NAND gates N1 found in other embodiments.

The sampling circuit 420 of this embodiment has advantages. First, sensing circuit 422 includes a resistor (and not a diode) connected in the feedback loop of op-amp OP2 and transistor MP5. In the embodiment of FIG. 2, a diode (that is, emulation diode D3) was connected in the feedback loop, and as noted above, it was therefore possible that current would not flow in the feedback leg. The embodiments of FIGS. 3 and 4 addressed this situation, through the inclusion of resistor R6 (FIG. 3) or transistor MD (FIG. 4) so as to cause a bleeder current to flow in the negative feedback leg. In the present embodiment, since resistor R7 is connected to the feedback loop, there is always current flowing in the feedback leg, and there is ordinarily no need to provide any additional components that would otherwise cause flow of a bleeder current.

In the above embodiments, the sampling circuits are connected so that they sample current through diode D2. However, they can instead be connected so as to sample current through diodes D1, as will be evident to those of ordinary skill. In addition, it will be evident that the precise circuitry for sampling and for current injection can be altered to fit the needs of particular embodiments.

The circuitry for embodiments of the present invention is preferably fabricated in CMOS technology, and preferably is fabricated on the same chip as other circuitry for which the invention is providing a voltage reference. Such other circuitry is described below.

Figure 6B:
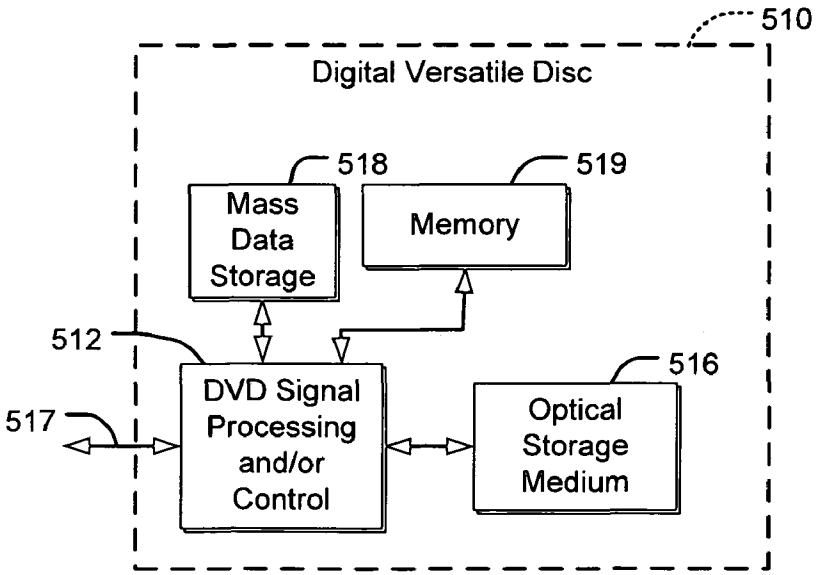
FIG. 6B is a block diagram of the invention in a DVD drive.
Figure 6A:
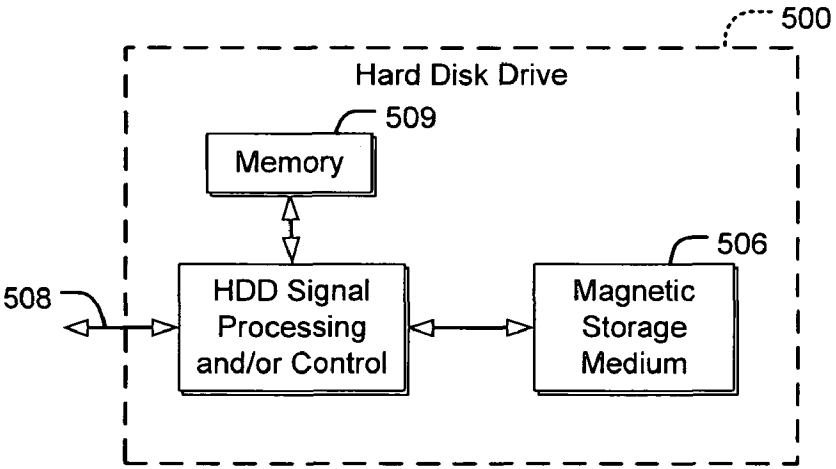
FIG. 6A is a block diagram showing an embodiment of the invention in a hard disk drive.

Referring now to FIGS. 6A-6G, various exemplary implementations of the present invention are shown. Referring to FIG. 6A, the present invention may be embodied as a voltage reference in a hard disk drive 500. The present invention may implement either or both signal processing and/or control circuits, which are generally identified in FIG. 6A at 502. In some implementations, signal processing and/or control circuit 502 and/or other circuits (not shown) in HDD 500 may process data, perform coding and/or encryption, perform calculations, and/or format data that is output to and/or received from a magnetic storage medium 506.

HDD 500 may communicate with a host device (not shown) such as a computer, mobile computing devices such as personal digital assistants, cellular phones, media or MP3 players and the like, and/or other devices via one or more wired or wireless communication links 508. HDD 500 may be connected to memory 509, such as random access memory (RAM), a low latency nonvolatile memory such as flash memory, read only memory (ROM) and/or other suitable electronic data storage.

Referring now to FIG. 6B, the present invention may be embodied as a voltage reference in a digital versatile disc (DVD) drive 510. The present invention may implement either or both signal processing and/or control circuits, which are generally identified in FIG. 6B at 512, and/or mass data storage 518 of DVD drive 510. Signal processing and/or control circuit 512 and/or other circuits (not shown) in DVD 510 may process data, perform coding and/or encryption, perform calculations, and/or format data that is read from and/or data written to an optical storage medium 516. In some implementations, signal processing and/or control circuit 512 and/or other circuits (not shown) in DVD 510 can also perform other functions such as encoding and/or decoding and/or any other signal processing functions associated with a DVD drive.

DVD drive 510 may communicate with an output device (not shown) such as a computer, television or other device via one or more wired or wireless communication links 517. DVD 510 may communicate with mass data storage 518 that stores data in a nonvolatile manner. Mass data storage 518 may include a hard disk drive (HDD) such as that shown in FIG. 6A. The HDD may be a mini HDD that includes one or more platters having a diameter that is smaller than approximately 1.8". DVD 510 may be connected to memory 519, such as RAM, ROM, low latency nonvolatile memory such as flash memory, and/or other suitable electronic data storage.

Figure 6D:
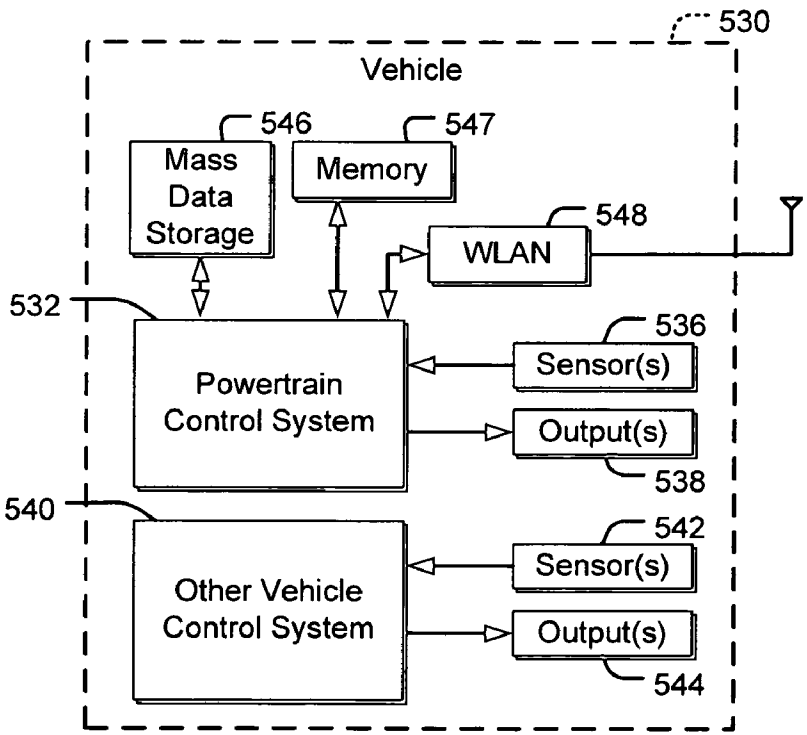
FIG. 6D is a block diagram of the invention in a vehicle control system.
Figure 6C:
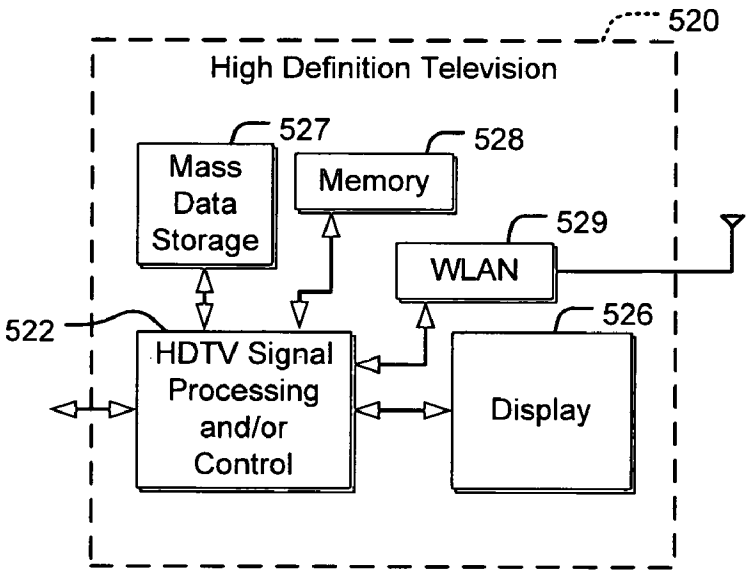
FIG. 6C is a block diagram of the invention in a high definition television (HDTV).

Referring now to FIG. 6C, the present invention may be embodied as a voltage reference in a high definition television (HDTV) 520. The present invention may implement either or both signal processing and/or control circuits, which are generally identified in FIG. 6C at 522, a WLAN interface and/or mass data storage of the HDTV 520. HDTV 520 receives HDTV input signals in either a wired or wireless format and generates HDTV output signals for a display 526. In some implementations, signal processing circuit and/or control circuit 522 and/or other circuits (not shown) of HDTV 520 may process data, perform coding and/or encryption, perform calculations, format data and/or perform any other type of HDTV processing that may be required.

HDTV 520 may communicate with mass data storage 527 that stores data in a nonvolatile manner such as optical and/or magnetic storage devices. At least one HDD may have the configuration shown in FIG. 6A and/or at least one DVD may have the configuration shown in FIG. 6B. The HDD may be a mini HDD that includes one or more platters having a diameter that is smaller than approximately 1.8". HDTV 520 may be connected to memory 528 such as RAM, ROM, low latency nonvolatile memory such as flash memory and/or other suitable electronic data storage. HDTV 520 also may support connections with a WLAN via a WLAN network interface 529.

Referring now to FIG. 6D, the present invention may be embodied as a voltage reference in a control system of a vehicle 530, a WLAN interface and/or mass data storage of the vehicle control system. In some implementations, the present invention implements a powertrain control system 532 that receives inputs from one or more sensors such as temperature sensors, pressure sensors, rotational sensors, airflow sensors and/or any other suitable sensors and/or that generates one or more output control signals such as engine operating parameters, transmission operating parameters, and/or other control signals.

The present invention may also be embodied in other control systems 540 of vehicle 530. Control system 540 may likewise receive signals from input sensors 542 and/or output control signals to one or more output devices 544. In some implementations, control system 540 may be part of an anti-lock braking system (ABS), a navigation system, a telematics system, a vehicle telematics system, a lane departure system, an adaptive cruise control system, a vehicle entertainment system such as a stereo, DVD, compact disc and the like. Still other implementations are contemplated.

Powertrain control system 532 may communicate with mass data storage 546 that stores data in a nonvolatile manner. Mass data storage 546 may include optical and/or magnetic storage devices for example hard disk drives HDD and/or DVDs. At least one HDD may have the configuration shown in FIG. 6A and/or at least one DVD may have the configuration shown in FIG. 6B. The HDD may be a mini HDD that includes one or more platters having a diameter that is smaller than approximately 1.8". Powertrain control system 532 may be connected to memory 547 such as RAM, ROM, low latency nonvolatile memory such as flash memory and/or other suitable electronic data storage. Powertrain control system 532 also may support connections with a WLAN via a WLAN network interface 548. The control system 540 may also include mass data storage, memory and/or a WLAN interface (all not shown).

Figure 6E:
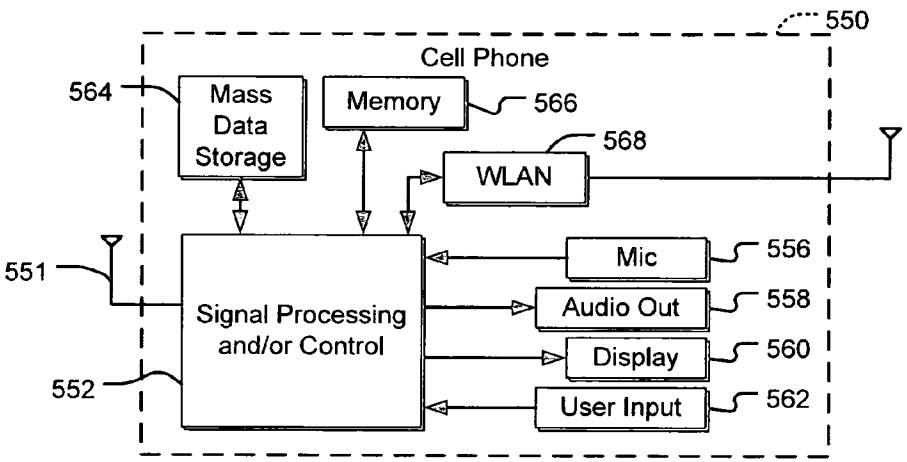
FIG. 6E is a block diagram of the invention in a cellular or mobile phone.

Referring now to FIG. 6E, the present invention may be embodied as a voltage reference in a cellular phone 550 that may include a cellular antenna 551. The present invention may implement either or both signal processing and/or control circuits, which are generally identified in FIG. 6E at 552, a WLAN interface and/or mass data storage of the cellular phone 550. In some implementations, cellular phone 550 includes a microphone 556, an audio output 558 such as a speaker and/or audio output jack, a display 560 and/or an input device 562 such as a keypad, pointing device, voice actuation and/or other input device. Signal processing and/or control circuits 552 and/or other circuits (not shown) in cellular phone 550 may process data, perform coding and/or encryption, perform calculations, format data and/or perform other cellular phone functions.

Cellular phone 550 may communicate with mass data storage 564 that stores data in a nonvolatile manner such as optical and/or magnetic storage devices for example hard disk drives HDD and/or DVDs. At least one HDD may have the configuration shown in FIG. 6A and/or at least one DVD may have the configuration shown in FIG. 6B. The HDD may be a mini HDD that includes one or more platters having a diameter that is smaller than approximately 1.8". Cellular phone 550 may be connected to memory 566 such as RAM, ROM, low latency nonvolatile memory such as flash memory and/or other suitable electronic data storage. Cellular phone 550 also may support connections with a WLAN via a WLAN network interface 568.

Figure 6F:
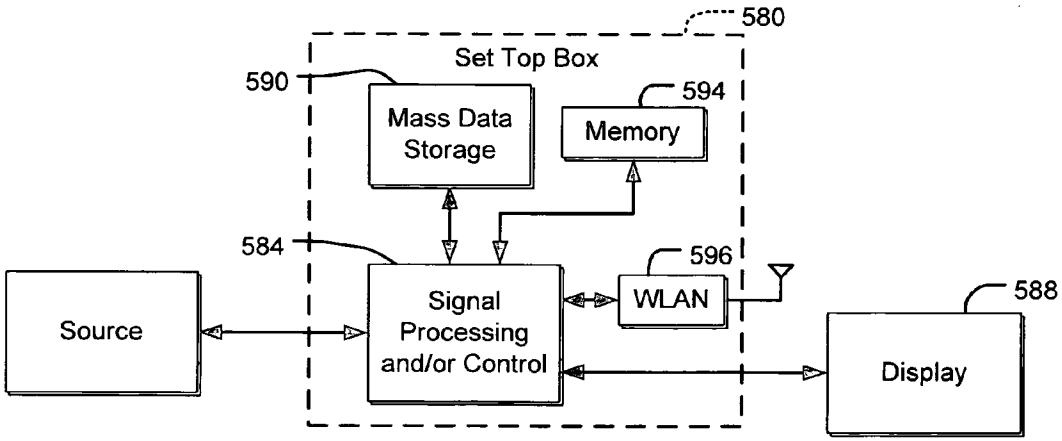
FIG. 6F is a block diagram of the invention in a set-top box (STB).

Referring now to FIG. 6F, the present invention may be embodied as a voltage reference in a set top box 580. The present invention may implement either or both signal processing and/or control circuits, which are generally identified in FIG. 6F at 584, a WLAN interface and/or mass data storage of the set top box 580. Set top box 580 receives signals from a source such as a broadband source and outputs standard and/or high definition audio/video signals suitable for a display 588 such as a television and/or monitor and/or other video and/or audio output devices. Signal processing and/or control circuits 584 and/or other circuits (not shown) of the set top box 580 may process data, perform coding and/or encryption, perform calculations, format data and/or perform any other set top box function.

Set top box 580 may communicate with mass data storage 590 that stores data in a nonvolatile manner. Mass data storage 590 may include optical and/or magnetic storage devices for example hard disk drives HDD and/or DVDs. At least one HDD may have the configuration shown in FIG. 6A and/or at least one DVD may have the configuration shown in FIG. 6B. The HDD may be a mini HDD that includes one or more platters having a diameter that is smaller than approximately 1.8". Set top box 580 may be connected to memory 594 such as RAM, ROM, low latency nonvolatile memory such as flash memory and/or other suitable electronic data storage. Set top box 580 also may support connections with a WLAN via a WLAN network interface 596.

Figure 6G:
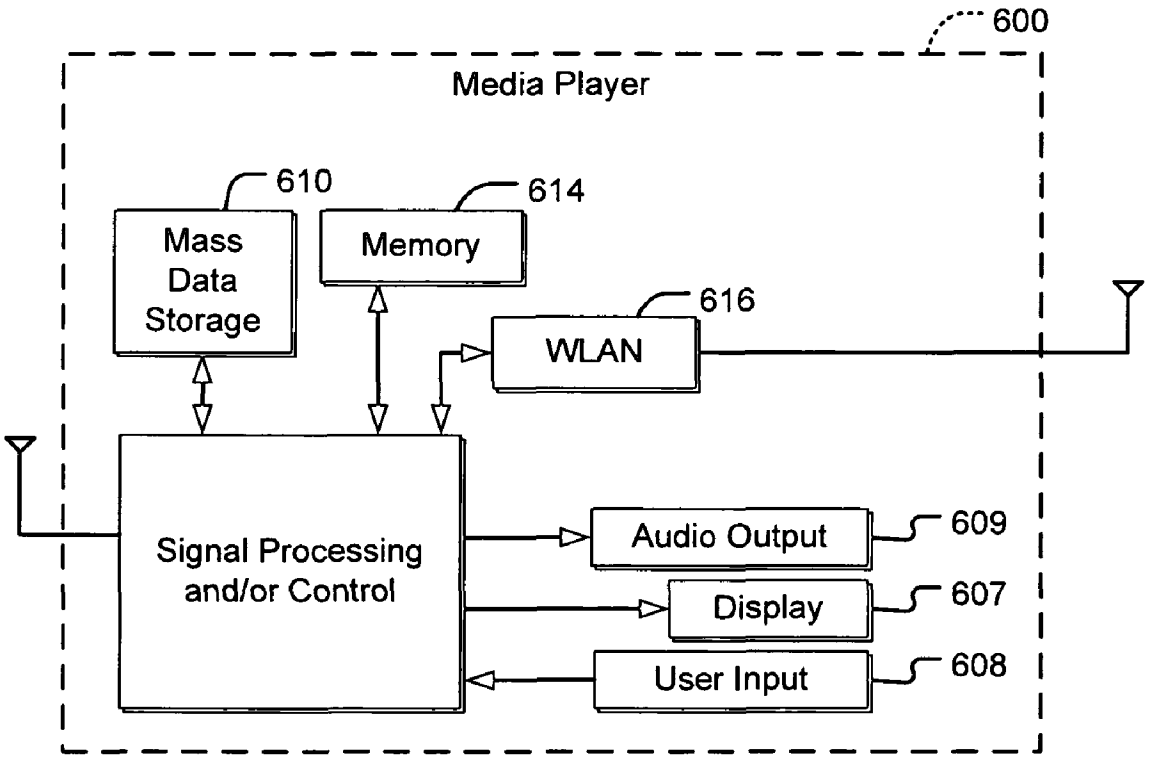
FIG. 6G is a block diagram of the invention in a media player.

Referring now to FIG. 6G, the present invention may be embodied as a reference voltage in a media player 600. The present invention may implement either or both signal processing and/or control circuits, which are generally identified in FIG. 6G at 604, a WLAN interface and/or mass data storage of the media player 600. In some implementations, media player 600 includes a display 607 and/or a user input 608 such as a keypad, touchpad and the like. In some implementations, media player 600 may employ a graphical user interface (GUI) that typically employs menus, drop down menus, icons and/or a point-and-click interface via display 607 and/or user input 608. Media player 600 further includes an audio output 609 such as a speaker and/or audio output jack. Signal processing and/or control circuits 604 and/or other circuits (not shown) of media player 600 may process data, perform coding and/or encryption, perform calculations, format data and/or perform any other media player function.

Media player 600 may communicate with mass data storage 610 that stores data such as compressed audio and/or video content in a nonvolatile manner. In some implementations, the compressed audio files include files that are compliant with MP3 format or other suitable compressed audio and/or video formats. The mass data storage may include optical and/or magnetic storage devices for example hard disk drives HDD and/or DVDs. At least one HDD may have the configuration shown in FIG. 6A and/or at least one DVD may have the configuration shown in FIG. 6B. The HDD may be a mini HDD that includes one or more platters having a diameter that is smaller than approximately 1.8". Media player 600 may be connected to memory 614 such as RAM, ROM, low latency nonvolatile memory such as flash memory and/or other suitable electronic data storage. Media player 600 also may support connections with a WLAN via a WLAN network interface 616. Still other implementations in addition to those described above are contemplated.

The invention has been described above with respect to particular illustrative embodiments. It is understood that the invention is not limited to the above-described embodiments and that various changes and modifications may be made by those skilled in the relevant art without departing from the spirit and scope of the invention.

What is claimed is:

1. A start-up circuit for a current and/or voltage reference in which the reference comprises:

a bandgap core including complementary PTAT (proportional-to-absolute-temperature) and CTAT (complementary-to-absolute-temperature) networks, wherein the PTAT and CTAT networks each include at least one diode; and an output circuit for outputting the reference, wherein the output circuit acts to combine outputs from the PTAT and CTAT networks;

wherein the start-up circuit comprises:

a sampling circuit to sample current in a diode of one of the PTAT and CTAT networks, the sampling circuit including an emulation diode structured in equivalence to that of the diode that is sampled, a differential amplifier, one differential input of the differential amplifier being connected to sample voltage at the diode that is sampled and the other differential input being connected to the emulation diode such that current through the emulation diode is substantially the same as current through the diode that is sampled, and such that voltage across the emulation diode is substantially the same as voltage across the diode that is sampled, and a transistor connected to the differential amplifier to create a negative feedback relationship for the differential amplifier; and a current injection circuit which injects current into the PTAT and CTAT networks if the current sampled by the sampling circuit is not higher than a pre-designated low value, wherein the injection of current is triggered at least partially based on a change of voltage across a resistor connected across the emulation diode to ensure that current flows through the transistor of the sampling circuit and thereby activates the negative feedback relationship of the differential amplifier.

2. A start-up circuit according to claim 1, further comprising a series-connected transistor connected in parallel across the emulation diode so as to further ensure that current flows through the transistor of the sampling circuit and thereby activates the negative feedback relationship of the differential amplifier.

3. A start-up circuit according to claim 1, wherein said current injection circuit comprises a current mirror driven by the output of the differential amplifier and providing a current to a resistor network selected in correspondence with the pre-designated low value, wherein a voltage across the resistor network triggers current injection to the PTAT and CTAT networks if current through the emulation diode falls below the pre-designated low value.

4. A start-up circuit for a current and/or voltage reference in which the reference comprises:

a bandgap core including complementary PTAT (proportional-to-absolute-temperature) and CTAT (complementary-to-absolute-temperature) networks, wherein the PTAT and CTAT networks each include at least one diode; and an output circuit for outputting the reference, wherein the output circuit acts to combine outputs from the PTAT and CTAT networks;

wherein the start-up circuit comprises:

a sampling circuit to sample current in a diode of one of the PTAT and CTAT networks; and a current injection circuit which injects current into the PTAT and CTAT networks if the current sampled by the sampling circuit is not higher than a pre-designated low value;

wherein the PTAT and CTAT networks each further includes a resistor connected in parallel with the at least one diode, wherein said sampling circuit comprises a sensing circuit and a subtraction circuit, wherein the sensing circuit samples current flowing through the resistor of said one of the PTAT and CTAT networks, and wherein said subtraction circuit subtracts the sampled current from the sum of current flowing through both of the resistor and the diode of said one of the PTAT and CTAT networks, so as to obtain the sample of current flowing through the diode that is sampled.

5. A start-up circuit according to claim 4, wherein said current injection circuit comprises a current mirror driven by the sample of current flowing through the diode that is sampled and providing a current to a resistor network selected in correspondence with the pre-designated low value, wherein a voltage across the resistor network triggers current injection to the PTAT and CTAT networks if the sample of current falls below the pre-designated low value.

6. A start-up circuit according to claim 1, wherein the PTAT network comprises a resistor connected in parallel with a series-connection of a resistor and multiple diodes, and wherein said CTAT network comprises a resistor connected in parallel with a diode.

7. A start-up circuit according to claim 6, wherein said sampling circuit samples current through the diode of the CTAT network.

8. A start-up circuit according to claim 1, fabricated in CMOS technology.

9. A start-up circuit according to claim 1, wherein the reference comprises a voltage reference and wherein the output circuit outputs a voltage of 1 v or less.

10. A reference circuit for a voltage and/or current reference, the reference circuit comprising:

a bandgap core including complementary PTAT (proportional-to-absolute-temperature) and CTAT (complementary-to-absolute-temperature) networks, wherein the PTAT and CTAT networks each include at least one diode;

an output circuit for outputting the reference, wherein the output circuit acts to combine outputs from the PTAT and CTAT networks;

a sampling circuit to sample current in a diode of one of the PTAT and CTAT networks, the sampling circuit including an emulation diode structured in equivalence to that of the diode that is sampled, a differential amplifier, one differential input of the differential amplifier being connected to sample voltage at the diode that is sampled and the other differential input is connected to the emulation diode such that current through the emulation diode is substantially the same as current the current through the diode that is sampled, and such that voltage across the emulation diode is substantially the same as voltage across the diode that is sampled, and a transistor connected to the differential amplifier so as to create a negative feedback relationship for the differential amplifier; and a current injection circuit which injects current into the PTAT and CTAT networks if the current sampled by the sampling circuit is not higher than a pre-designated low value, wherein the injection of current is triggered at least partially based on a change of voltage across a resistor connected across the emulation diode so as to ensure that current flows through the transistor of the sampling circuit and thereby activates the negative feedback relationship of the differential amplifier.

11. A reference circuit according to claim 10, further comprising a series-connected transistor connected in parallel across the emulation diode so as to further ensure that current flows through the transistor of the sampling circuit and thereby activates the negative feedback relationship of the differential amplifier.

12. A reference circuit according to claim 10, wherein said current injection circuit comprises a current mirror driven by the output of the differential amplifier and providing a current to a resistor network selected in correspondence with the pre-designated low value, wherein a voltage across the resistor network triggers current injection to the PTAT and CTAT networks if current through the emulation diode falls below the pre-designated low value.

13. A reference circuit for a voltage and/or current reference, the reference circuit comprising:

a bandgap core including complementary PTAT (proportional-to-absolute-temperature) and CTAT (complementary-to-absolute-temperature) networks, wherein the PTAT and CTAT networks each include at least one diode;

an output circuit for outputting the reference, wherein the output circuit acts to combine outputs from the PTAT and CTAT networks;

a sampling circuit to sample current in a diode of one of the PTAT and CTAT networks; and a current injection circuit which injects current into the PTAT and CTAT networks if the current sampled by the sampling circuit is not higher than a pre-designated low value;

wherein the PTAT and CTAT networks each further includes a resistor connected in parallel with at least one diode, wherein said sampling circuit comprises a sensing circuit and a subtraction circuit, wherein the sensing circuit samples current flowing through the resistor of said one of the PTAT and CTAT networks, and wherein said subtraction circuit subtracts the sampled current from the sum of current flowing through both of the resistor and the diode of said one of the PTAT and CTAT networks, so as to obtain the sample of current flowing through the diode that is sampled.

14. A reference circuit according to claim 13, wherein said current injection circuit comprises a current mirror driven by the sample of current flowing through the diode that is sampled and providing a current to a resistor network selected in correspondence with the pre-designated low value, wherein a voltage across the resistor network triggers current injection to the PTAT and CTAT networks if the sample of current falls below the pre-designated low value.

15. A reference circuit according to claim 10, wherein the PTAT network comprises a resistor connected in parallel with a series-connection of a resistor and multiple diodes, and wherein said CTAT network comprises a resistor connected in parallel with a diode.

16. A reference circuit according to claim 15, wherein said sampling circuit samples current through the diode of the CTAT network.

17. A reference circuit according to claim 10, fabricated in CMOS technology.

18. A reference circuit according to claim 10, wherein the reference comprises a voltage reference and wherein the output circuit outputs a voltage of 1 v or less.

19. A reference circuit for a voltage and/or current reference, the reference circuit comprising:

bandgap core means including complementary PTAT (proportional-to-absolute-temperature) and CTAT (complementary-to-absolute-temperature) networks, wherein the PTAT and CTAT networks each include at least one diode;

output means for outputting the reference, wherein the output means acts to combine outputs from the PTAT and CTAT networks;

sampling means for sampling current in a diode of one of the PTAT and CTAT networks, the sampling means including an emulation diode structured in equivalence to that of the diode that is sampled, a differential amplifier, one differential input of the differential amplifier being connected so as to sample voltage at the diode that is sampled and the other differential input being connected to the emulation diode, such that current through the emulation diode is substantially the same as current through the diode that is sampled, and such that voltage across the emulation diode is substantially the same as voltage across the diode that is sampled, and a transistor connected to the differential amplifier so as to create a negative feedback relationship for the differential amplifier; and current injection means which injects current into the PTAT and CTAT networks if the current sampled by the sampling means is not higher than a pre-designated low value, wherein the injection of current is triggered at least partially based on a change of voltage across a resistor connected across the emulation diode so as to ensure that current flows through the transistor of the sampling means and thereby activates the negative feedback relationship of the differential amplifier.

20. A reference circuit according to claim 19, further comprising a series-connected transistor connected in parallel across the emulation diode so as to further ensure that current flows through the transistor of the sampling means and thereby activates the negative feedback relationship of the differential amplifier.

21. A reference circuit according to claim 19, wherein said current injection means comprises a current mirror driven by the output of the differential amplifier and providing a current to a resistor network selected in correspondence with the pre-designated low value, wherein a voltage across the resistor network triggers current injection to the PTAT and CTAT networks if current through the emulation diode falls below the pre-designated low value.

22. A reference circuit for a voltage and/or current reference, the reference circuit comprising:

bandgap core means including complementary PTAT (proportional-to-absolute-temperature) and CTAT (complementary-to-absolute-temperature) networks, wherein the PTAT and CTAT networks each include at least one diode;

output means for outputting the reference, wherein the output means acts to combine outputs from the PTAT and CTAT networks;

sampling means for sampling current in a diode of one of the PTAT and CTAT networks; and current injection means which injects current into the PTAT and CTAT networks if the current sampled by the sampling means is not higher than a pre-designated low value;

wherein the PTAT and CTAT networks each further includes a resistor connected in parallel with at least one diode, wherein said sampling means comprises a sensing circuit and a subtraction circuit, wherein the sensing circuit samples current flowing through the resistor of said one of the PTAT and CTAT networks, and wherein said subtraction circuit subtracts the sampled current from the sum of current flowing through both of the resistor and the diode of said one of the PTAT and CTAT networks, so as to obtain the sample of current flowing through the diode that is sampled.

23. A reference circuit according to claim 22, wherein said current injection means comprises a current mirror driven by the sample of current flowing through the diode that is sampled and providing a current to a resistor network selected in correspondence with the pre-designated low value, wherein a voltage across the resistor network triggers current injection to the PTAT and CTAT networks if the sample of current falls below the pre-designated low value.

24. A reference circuit according to claim 19, wherein the PTAT network comprises a resistor connected in parallel with a series-connection of a resistor and multiple diodes, and wherein said CTAT network comprises a resistor connected in parallel with a diode.

25. A reference circuit according to claim 24, wherein said sampling means samples current through the diode of the CTAT network.

26. A reference circuit according to claim 19, fabricated in CMOS technology.

27. A reference circuit according to claim 19, wherein the reference comprises a voltage reference and wherein the output circuit outputs a voltage of 1 v or less.

28. A method for start-up of a current and/or voltage reference in which the reference comprises:

a bandgap core including complementary PTAT (proportional-to-absolute-temperature) and CTAT (complementary-to-absolute-temperature) networks, wherein the PTAT and CTAT networks each include at least one diode; and an output circuit for outputting the reference, wherein the output circuit acts to combine outputs from the PTAT and CTAT networks;

wherein said method comprises the steps of:

sampling current in a diode of one of the PTAT and CTAT networks; and injecting current into the PTAT and CTAT networks if the sampled current is not higher than a pre-designated low value;

wherein the sampling step comprises differential amplification of voltage at the diode that is sampled by using a differential amplifier connected to a transistor so as to create a negative feedback relationship for the differential amplifier and an emulation diode equivalent to the diode that is sampled, such that current through the emulation diode is substantially the same as that through the diode that is sampled, and such that voltage across the emulation diode is substantially the same as that across the diode that is sampled, and wherein the injection of current is triggered at least partially based on a change of voltage across a resistor connected across the emulation diode to ensure that current flows through the transistor of the sampling means and thereby activate the negative feedback relationship of the differential amplifier.

29. A method according to claim 28, further comprising the step of providing a series-connected transistor connected in parallel across the emulation diode so as to provide a bleeder current to further ensure activation of the negative feedback relationship.

30. A method according to claim 28, wherein said current injection step comprises the step of mirroring current through a current mirror driven by output of the differential amplification step and providing a current to a resistor network selected in correspondence with the pre-designated low value, wherein a voltage across the resistor network triggers current injection to the PTAT and CTAT networks if current through the emulation diode falls below the pre-designated low value.

31. A method for start-up of a current and/or voltage reference in which the reference comprises:

a bandgap core including complementary PTAT (proportional-to-absolute-temperature) and CTAT (complementary-to-absolute-temperature) networks, wherein the PTAT and CTAT networks each include at least one diode; and an output circuit for outputting the reference, wherein the output circuit acts to combine outputs from the PTAT and CTAT networks;

wherein said method comprises the steps of:

sampling current in a diode of one of the PTAT and CTAT networks; and injecting current into the PTAT and CTAT networks if the sampled current is not higher than a pre-designated low value;

wherein the PTAT and CTAT networks each further include a resistor connected in parallel with at least one diode, wherein said method further comprises:

sensing current flowing through the resistor of said one of the PTAT and CTAT networks, and subtracting the sampled current from the sum of current flowing through both of the resistor and the diode of said one of the PTAT and CTAT networks, so as to obtain the sample of current flowing through the diode that is sampled.

32. A method according to claim 31, wherein said current injecting step comprises the step of providing a mirrored current to a resistor network selected in correspondence with the pre-designated low value, wherein a voltage across the resistor network triggers current injection to the PTAT and CTAT networks if the sample of current falls below the pre-designated low value.

33. A method according to claim 28, wherein the PTAT network comprises a resistor connected in parallel with a series-connection of a resistor and multiple diodes, and wherein said CTAT network comprises a resistor connected in parallel with a diode.

34. A method according to claim 33, wherein said sampling step samples current through the diode of the CTAT network.

35. A method according to claim 28, wherein the reference is fabricated in CMOS technology.

36. A method according to claim 28, wherein the reference provides a voltage reference, and wherein the output circuit outputs a voltage of 1 v or less.

* * * * *